US009329519B2

(12) United States Patent
Kikuchi et al.

(10) Patent No.: US 9,329,519 B2
(45) Date of Patent: May 3, 2016

(54) CHARGING ROLLER, CHARGING DEVICE AND IMAGE FORMING APPARATUS INCORPORATING SAME, AND METHOD OF CALCULATING RESISTANCE OF CHARGING ROLLER

(71) Applicants: Hisashi Kikuchi, Kanagawa (JP); Kazuhiko Watanabe, Tokyo (JP); Takaaki Tawada, Kanagawa (JP); Eisuke Shimizu, Kanagawa (JP)

(72) Inventors: Hisashi Kikuchi, Kanagawa (JP); Kazuhiko Watanabe, Tokyo (JP); Takaaki Tawada, Kanagawa (JP); Eisuke Shimizu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/729,208

(22) Filed: Jun. 3, 2015

(65) Prior Publication Data

US 2015/0355566 A1 Dec. 10, 2015

(30) Foreign Application Priority Data

Jun. 9, 2014 (JP) ..... 2014-118461

(51) Int. Cl.
*G03G 15/02* (2006.01)

(52) U.S. Cl.
CPC ..... *G03G 15/0233* (2013.01); *G03G 15/0266* (2013.01)

(58) Field of Classification Search
CPC ..... G03G 15/0233; G03G 15/0266
See application file for complete search history.

(56) References Cited

U.S. PATENT DOCUMENTS 5,390,007 A * 2/1995 Kugoh ..... G03G 15/0233 361/221
6,332,064 B1 * 12/2001 Sato ..... G03G 15/0216 399/128

FOREIGN PATENT DOCUMENTS

JP 2011-248380 12/2011

* cited by examiner

*Primary Examiner* — G. M. Hyder
(74) *Attorney, Agent, or Firm* — Harness, Dickey & Pierce, P.L.C.

(57) ABSTRACT

A charging roller to apply voltage to a target to charge the target has a surface having a color set in one of a range according to CIE L*a*b* color space and a range according to CIE XYZ color space, and the range according to CIE L*a*b* color space is defined as 32.6≤L*≤50.9, 0.51≤a*≤1.12, and 6.0≤b*≤8.4; and the range according to CIE XYZ color space is defined as 8.8≤X≤21.0, 9.1≤Y≤21.3, and 5.7≤Z≤11.8.

20 Claims, 4 Drawing Sheets

| RESISTANCE (Ω) | L* | a* | b* | X | Y | Z |
|---|---|---|---|---|---|---|
| 9.00E+04 | 31.36 | 0.33 | 5.83 | 7.78 | 8.10 | 5.38 |
| 1.10E+05 | 34.27 | 0.67 | 6.17 | 9.99 | 10.26 | 6.86 |
| 3.60E+05 | 40.18 | 0.86 | 7.04 | 13.82 | 14.17 | 9.30 |
| 7.00E+05 | 50.11 | 1.10 | 8.22 | 20.00 | 20.37 | 13.68 |

CHARGING ROLLER, CHARGING DEVICE AND IMAGE FORMING APPARATUS INCORPORATING SAME, AND METHOD OF CALCULATING RESISTANCE OF CHARGING ROLLER

CROSS-REFERENCE TO RELATED APPLICATIONS

This patent application is based on and claims priority pursuant to 35 U.S.C. §119(a) to Japanese Patent Application No. 2014-118461, filed on Jun. 9, 2014, in the Japan Patent Office, the entire disclosure of which is hereby incorporated by reference herein.

BACKGROUND

1. Technical Field

Embodiments of the present invention generally relate to a charging roller, a charging device, and an image forming apparatus, such as a copier, a printer, a facsimile machine, a plotter, or a multifunction peripheral (MFP) including at least two of copying, printing, facsimile transmission, plotting, and scanning capabilities.

2. Description of the Related Art

In electrophotographic image forming apparatuses such as copiers, printers, and facsimile machines, an electrostatic latent image is formed on an image bearer and developed with toner into a visible image. Then, the image is transferred onto a sheet (i.e., a recording medium) and fixed thereon.

Image forming apparatuses employing electrophotography or electrostatic recording typically include a charging device to charge the surface of the image bearer such as a photoconductor. For example, a corona charging device is disposed contactlessly with a target to be charged so that a discharge opening thereof faces the target. The surface of the target is exposed to corona current flowing from the discharge opening, and then the target is charged to a predetermined potential in a predetermined polarity.

Corona charging devices require high-voltage power supplies and generate discharge products such as ozone and nitrogen oxide due to corona discharge, and charging efficiency thereof is relatively low. Further, discharge wire is likely to be soiled.

Currently, progress has been made in contact-type charging devices that are lower in power consumption, higher in charging efficiency, and generate a smaller amount of discharge products. Contact-type charging devices include a conductive charger to be disposed in contact with the target to be charged. Voltage is applied to the charger to induce discharging toward the target so that the surface of the target is charged to the predetermined potential. The charger can be any of a roller, a blade, a rod, and a brush.

It is to be noted that, similar to the arrangement in which the charger is disposed in contact with the target, the target can be charged by applying a charging bias to the charger disposed facing the target across a small clearance that allows discharging between the charger and the target. Since the charger does not contact the target, toner, paper dust, contaminant, toner additives, and the like adhering to the target are less likely to adhere to the charger. This configuration can obviate the necessity of cleaning of the charger or simplify a cleaning structure therefor. Accordingly, the device can be simplified and reduced in size, and damage to the charger due to friction can be inhibited.

Widely used in contact-type charging is roller charging, which uses a conductive roller. Conductive rollers typically include a metal core and an elastic conductive layer (made of rubber, for example) overlying the metal core. Reliable charging is available with roller charging.

Types of bias application of contact-type charging include a direct current (DC) charging, in which DC voltage as the charging bias is applied to the charger, and an alternating current (AC) charging, in which the charging bias includes AC voltage superimposed on DC voltage. In either charging type, the surface of the target is charged to the predetermined potential by the contract-type charger, to which the charging bias is applied.

Uniform discharging is difficult in DC charging, and practical use of DC charging is difficult unless an ion-conductive component is used. Thus, usable materials are limited. Additionally, the resistance value of the ion-conductive component largely depends on environments, and half a digit or double-digit changes in resistance value are possible in response to temperature changes. Additionally, surface irregularity of the roller is likely to result in uneven charging, which can degrade image quality. Even if the surface irregularity is reduced, it is possible that surface properties thereof are degraded due to abrasion over time or toner and dust adhering thereto. Then, uniform charging becomes difficult.

By contrast, AC charging is superior to DC charging in terms of uniform charging potential (tribo-electric potential). Uneven image density is suppressed and streaks in images due to poor charging are less likely to occur in AC charging.

In AC charging, however, the charging currant is larger, and damage to the image bearer such as the photoconductor is larger. Accordingly, compared with DC charging, the image bearer, which is charged, is abraded more over time, and the operational life of the image bearer is reduced. Specifically, when an excessive amount of AC voltage is used, the amount of AC discharge current flowing between the charger and the target increases. As a result, the surface of the photoconductor, which is the target to be charged in the image forming apparatus, is abraded. Thus, degradation of the surface of the target is promoted. Additionally, under hot and humid conditions, the occurrence of image failure such as image deletion, caused by discharge products adhering to the target, increases.

SUMMARY

An embodiment of the present invention provides a charging roller to apply voltage to a target to charge the target. A color of a surface of the charging roller is set according to CIE L*a*b* color space as $32.6 \leq L^* \leq 50.9$, $0.51 \leq a^* \leq 1.12$, and $6.0 \leq b \leq 8.4$. Alternatively, the color of the surface of the charging roller is set according to CIE XYZ color space as $8.8 \leq X \leq 21.0$, $9.1 \leq Y \leq 21.3$, and $5.7 \leq Z \leq 11.8$.

In another embodiment, a charging device includes the above-de-scribed charging roller.

In yet another embodiment, an image forming apparatus includes the above-described charging roller, an image bearer to be charged by the charging roller, an exposure device to form an electrostatic latent image on the image bearer according to image data, a developing device to develop the electrostatic latent image into a toner image, a transfer device to transfer the toner image onto a transfer medium, and a cleaning device to remove toner from the image bearer after the toner image is transferred therefrom.

Yet another embodiment provides a method of calculating a resistance of a charging roller. The method includes a step of establishing a relation between the resistance of the charging roller and a surface color of the charging roller; and a step of calculating the resistance of the charging roller using a formula based on the established formula.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
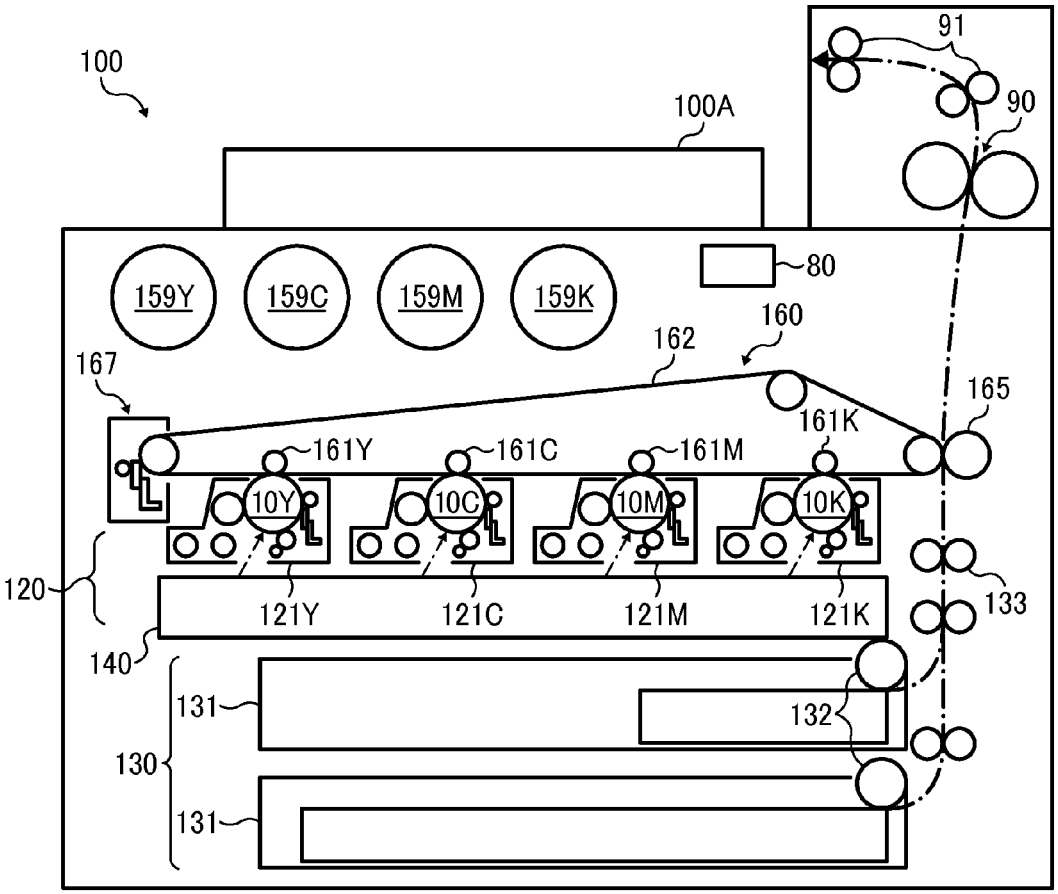
FIG. 1 is a schematic view of an image forming apparatus incorporating a charging device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the term "contact-type charging" used in this specification includes an arrangement in which a charger is disposed contactless with a target to be charged, across a small clearance (for example, in the range from several micrometers to several hundred micrometers) that allows discharging between the charger and the target.

According to understanding of the inventors, the resistance of the charger such as a charging roller affects a charging current required to charge the surface of an image bearer such as a photoconductor while inhibiting image failure such as white spots caused by undesired discharging. In other words, the required charging current tends to increase as the resistance increases. When the resistance is high, the charging current increases particularly under a relatively low temperature, and the damage to the photoconductor increases.

Resistances of charging rollers are generally checked by sampling in lots. For example, the charging roller is pressed against opposed electrodes serving as a probe under conditions such as a single-side load of 500 grams, and voltage is applied between the metal core and the opposed electrodes. Then, the value of current is measured, thereby obtaining the resistance.

The resistance of the charging roller varies depending on production lots of materials, content of materials, variations in manufacturing. In a specified range of the resistance, about ±0.5 log Ω is allowed as a tolerance to a center value.

Considering the upper and lower limits of the tolerance, the resistance fluctuates by about one digit, and the charging current can be extremely high at the upper limit of the resistance.

Typically, the charging current is set at a strict upper limit, and thus the amount of current is excessive for the charging roller at the center in the specified range. Consequently, as described above, damage to the photoconductor becomes large.

Reducing the range of tolerance is effective in inhibiting the damage to the surface of the target to be charged. If all charging rollers are inspected for resistance and suitable ones are selected from them, the tolerance range can be reduced. However, time and cost for the check are required. Additionally, since the charging roller is pressed to contact the electrode, there are risks of deform of the charging roller and adhesion of contaminant to the charging roller.

The embodiments described below provide a charger having a predetermined resistance, a charging device including the charger, and an image forming apparatus including the charger while inhibiting increases in time and cost for measuring the resistance, mechanical deformation during inspection, and adhesion of contaminants to the charger.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic view of an image forming apparatus 100 incorporating a charger according to the present embodiment.

For example, the image forming apparatus 100 is a printer, but the present embodiment can adapt to other types of image forming apparatuses such as copiers, facsimile machines, and multifunction peripheral (MFP) capable of at least two of copying, printing, facsimile transmission, plotting, and scanning.

The image forming apparatus 100 illustrated in FIG. 1 is capable of multicolor image formation.

The image forming apparatus 100 includes a multicolor image forming unit 120, an intermediate transfer device 160, and a sheet feeder 130 as main components. It is to be noted that reference characters Y, M, C, and K represent yellow, magenta, cyan, and black, respectively, and may be omitted in the description below when color discrimination is not necessary.

The multicolor image forming unit 120 includes four process cartridges 121Y, 121M, 121C, and 121K having a similar configuration, arranged in parallel to each other along entrained face of an intermediate transfer belt 162 of the intermediate transfer device 160.

The process cartridges 121Y, 121C, 121M, and 121K (collectively "process cartridge 121") respectively include drum-shaped photoconductors 10Y, 10M, 10C, and 10K (collectively "photoconductors 10") serving as image bearers. The process cartridge 121 serves as a single-color image forming device. It is to be noted that, in descriptions with reference to FIG. 2, only components for yellow are mentioned.

The image forming apparatus 100 further includes a controller 80 that includes, for example, a central processing unit (CPU), memories such as a random access memory (RAM) and a read-only memory (ROM), and the like. The controller 80 performs various types of control processing by executing programs stored in the memory.

Figure 2:
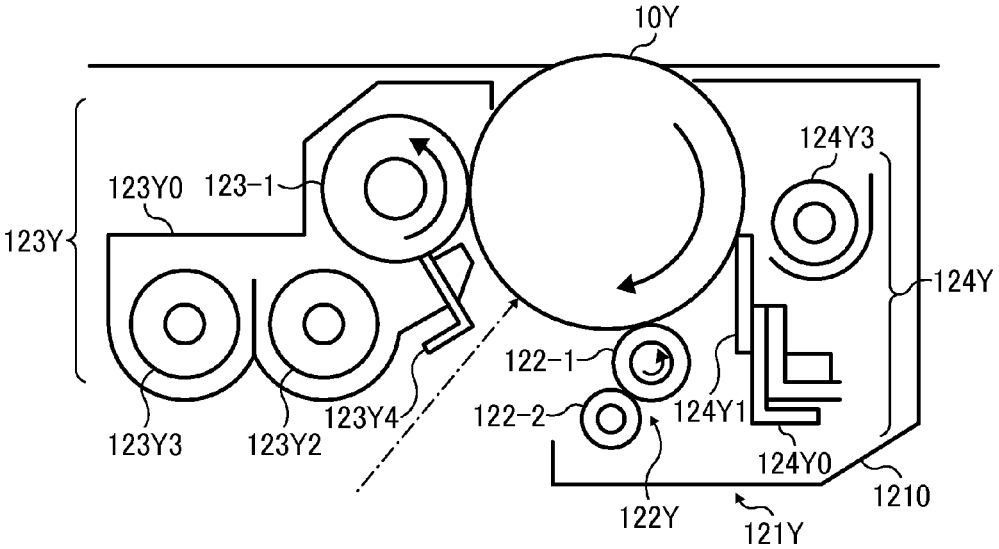
FIG. 2 is a schematic cross-sectional view of a process cartridge usable in the image forming apparatus illustrated in FIG. 1.

Referring to FIG. 2, around the photoconductor 10Y, image forming components, namely, a charging device 122Y, a developing device 123Y, and a cleaning device 124Y are disposed around the photoconductor 10Y. The image forming components perform image forming processes in a direction in which the photoconductor 10Y rotates. The photoconductor 10Y and at least one of the image forming components are held by a common unit casing 1210 of the process cartridge 121Y as a modular unit removably installed in the image forming apparatus 100.

As illustrated in FIG. 1, beneath the process cartridges 121, an exposure device 140 is provided. The exposure device 140 optically writes electrostatic latent images on the photoconductors 10 according to image data. The intermediate transfer belt 162 of the intermediate transfer device 160 is situated above the photoconductors 10.

The intermediate transfer device 160 includes the intermediate transfer belt 162, which is an endless belt serving as an intermediate transfer member, primary transfer rollers 161Y, 161C, 161M, and 161K, and a secondary transfer roller 165. The intermediate transfer device 160 is entrained around multiple support rollers.

One (a lower face in FIG. 1) of taut faces of the intermediate transfer belt 162, entrained around the multiple rollers, is opposed to the process cartridges 121. The intermediate transfer belt 162 rotates in accordance with the speed at which the photoconductors 10 rotate. With this configuration, the primary transfer rollers 161 primarily transfer toner images from the respective photoconductors 10 onto the intermediate transfer belt 162 and superimpose the toner images one on another thereon, into a multicolor image.

The process cartridges 121 have a similar configuration and perform similar operation to form toner images on the respective photoconductors 10 and transfer the toner images onto the intermediate transfer belt 162.

A pivot mechanism is provided for the three primary transfer rollers 161Y, 161C, and 161M corresponding to the process cartridges 121Y, 121C, and 121M for colors other than black to move these primary transfer rollers 161 vertically in FIG. 1. The pivot mechanism disengages the intermediate transfer belt 162 from the photoconductors 10Y, 10C, and 10M when multicolor image formation is not performed.

The intermediate transfer device 160 is removably installable in a body of the image forming apparatus 100.

Specifically, a front cover, on the front side of the paper on which FIG. 1 is drawn, covering the multicolor image forming unit 120 is opened, and the intermediate transfer device 160 is slid out from the back side of the paper on which FIG. 1 is drawn to the front side of the paper. Thus, intermediate transfer device 160 is removed from the image forming apparatus 100.

The intermediate transfer device 160 can be installed into the body of the image forming apparatus 100 in the procedure reverse to the installation thereof.

The multicolor image in which the respective color images are superimposed, or a single-color image, is transferred by the secondary transfer roller 165 onto a sheet serving as a recording medium. The secondary transfer roller 165 is positioned downstream from the four process cartridges 121 in the direction in which the intermediate transfer belt 162 rotates.

In FIG. 1, a belt cleaning device 167 is disposed downstream from the secondary transfer roller 165 and upstream from the process cartridge 121Y in the direction indicated by arrow A shown in FIG. 1, in which the intermediate transfer belt 162 rotates.

The belt cleaning device 167 and the intermediate transfer belt 162 are supported by a common support and are removably installable at a time in the body of the image forming apparatus 100 as a part of the intermediate transfer device 160.

Above the intermediate transfer device 160, toner cartridges 159 for the respective process cartridges 121 are arranged substantially horizontally.

The sheet feeder 130 is provided beneath the exposure device 140. The sheet feeder 130 includes sheet trays 131 for containing sheets of recording media and sheet feeding rollers 132. The sheet fed by the sheet feeding roller 132 is transported by multiple conveyance rollers and a registration roller pair 133 to the secondary transfer roller 165 at a predetermined timing. The secondary transfer roller 165 presses against the intermediate transfer belt 162, and a contact portion therebetween is referred to as "secondary transfer nip".

Additionally, a fixing device 90 is disposed downstream from the secondary transfer nip in the direction in which the sheet is transported.

The fixing device 90 employs heating roller fixing and includes a fixing roller containing a heater and a pressure roller pressing against the fixing roller, and a contact portion therebetween is referred to as "fixing nip".

Further, ejection rollers 91 and an output tray 100A to store sheets discharged are disposed downstream from the fixing device 90 in the direction in which the sheet is transported.

The charging device 122Y of the process cartridge 121Y illustrated in FIG. 2 includes a charging roller 122-1. The process cartridge 121Y further includes a cleaning roller 122-2, serving as a cleaner to clean the charging roller 122-1 and the cleaning device 124Y to clean the photoconductor 10Y.

The cleaning roller 122-2 can be any of rollers including a sponge layer made of polyurethane, melamine resin, or the like overlying a metal core and brush rollers having conductive or insulative fibers made of nylon, acrylic resin, polyester, or the like. The cleaning roller 122-2 is disposed in contact with the charging roller 122-1.

The cleaning roller 122-2 is rotated by either rotation of the charging roller 122-1 or a driving device. The cleaning roller 122-2 and the charging roller 122-1 rotate in an identical direction in a contact portion therebetween, and thus the cleaning roller 122-2 removes substances adhering to a surface of the charging roller 122-1.

The cleaning device 124Y includes an elastic blade 124Y1 that is long in the axial direction of the photoconductor 10Y and a support 124Y0 to support the blade 124Y1. An end of the blade 124Y1 in a longitudinal direction thereof is pressed against the surface of the photoconductor 10Y to remove substances such as residual toner adhering to the surface of the photoconductor 10Y. The blade 124Y1 is made of or includes an elastic material such as urethane rubber. It is to be noted that reference character 124Y3 represents a screw to transport toner removed by the blade 124Y1 to the developing device 123Y or a waste toner container.

In the configuration illustrated in FIG. 2, the developing device 123Y includes a developer container 123Y0 and a developing roller 123-1, serving as a developer bearer, to bear developer on its surface, inside the developer container 123Y0. A supply roller 123Y2 is disposed in a partitioned compartment beneath the developing roller 123-1. The supply roller 123Y2 scoops up developer and supplies the developer to the developing roller 123-1. Toner collected from the developing roller 123-1 is introduced into another compartment in which an agitation roller 123Y3 is disposed. The agitation roller 123Y3 stirs the toner and transports the toner to the supply roller 123Y2. Fresh toner is supplied from the toner cartridge 159Y illustrated in FIG. 1 into the compartment in which the agitation roller 123Y3 is disposed to keep the concentration of toner in developer constant. A doctor blade 123Y4 regulates a layer thickness of the developer supplied from the supply roller 123Y2 onto the developing roller 123-1 A (i.e., a developing sleeve). Then, the developer is supplied toward the photoconductor 10Y.

The photoconductor 10Y included in the process cartridge 121Y illustrated in FIG. 2 has the following structure.

The photoconductor 10Y includes at least a photosensitive layer above a conductive substrate and a resin surface layer including inorganic particles dispersed therein.

In the configuration illustrated in FIGS. 1 and 2, the photoconductor 10Y has the following layer structure.

For example, the photosensitive layer is provided above the conductive substrate, and inorganic particles are positioned close to the surface thereof. Alternatively, the photosensitive layer and the surface layer including inorganic particles are provided in that order above the conductive substrate. Alternatively, the photoconductor 10Y includes, from the bottom, the conductive substrate, a base coat, a multilayered photosensitive layer, and the surface layer including inorganic particles. The multilayered photosensitive layer includes a charge generation layer and a charge transport layer.

Since the photoconductor 10Y is repeatedly used for a long time, the photoconductor 10Y preferably has a high mechanical durability not to wear easily.

Inside the image forming apparatus 100, the charging roller 122-1 of the charging device 122Y and the like produce ozone and $NO_x$ gas, and such gas tends to adhere to the surface of the photoconductor 10Y, resulting in image deletion. To prevent image deletion, it is necessary to abrade the surface layer (or the photosensitive layer) at a predetermined speed. Therefore, it is preferred that the surface layer have a thickness of 1.0 μm or greater for the repeated use for a long time. When the thickness of the surface layer is greater than 8.0 μm, the residual potential can rise and reproducibility of fine dots can decrease.

With addition of fine inorganic particles thereto, minute surface irregularities is caused, making the surface of the photoconductor 10Y uneven. The uneven surface reduces adhesion of a toner base and additives to the photoconductor 10Y, and filming of the toner base and the additives on the photoconductor 10Y is inhibited.

Additionally, as the surface roughness, the photoconductor 10Y preferably has a ten-point mean roughness Rz within a range from about 0.3 μm to about 1.0 μm. For example, SURFCOM 1400D, manufactured by TOKYO SEIMITSU CO., LTD., is used to measure the surface roughness of the photoconductor 10Y. It is to be noted that the term "ten-point mean roughness Rz" is also simply referred to as "surface roughness Rz" in the description below.

The charging device 122Y includes the charging roller 122-1 disposed to face the photoconductor 10Y with the intermediate transfer belt 162 interposed therebetween. The charging roller 122-1 rotates following the rotation of the photoconductor 10Y. The charging roller 122-1 is provided with the cleaning roller 122-2 disposed in contact with the charging roller 122-1 and rotatably to remove substances adhering to the charging roller 122-1.

The charging roller 122-1 is an elastic roller including a metal core and an elastic layer made of an elastic conductive material, such as rubber, overlaying the metal core.

For example, as the elastic conductive layer, a conductive material is included in an elastic material such as polyurethane, epichlorohydrin rubber, nitrile rubber, styrene rubber, and chloroprene rubber. Examples of the conductive material included in a rubber base include conductivity improvers such as carbon black; electrically conductive materials such as metal powder; ionic conductive materials such as organic salts, inorganic salts, metal complexes, ionic liquid; and combination of those.

It is to be noted that the resistance of the charging roller 122-1 is adjustable with the amount of the conductivity improver. When the amount of the conductivity improver is greater, the resistance is lower, and the color (or chromaticity) of the charging roller 122-1 tends to darken.

Figure 3A:
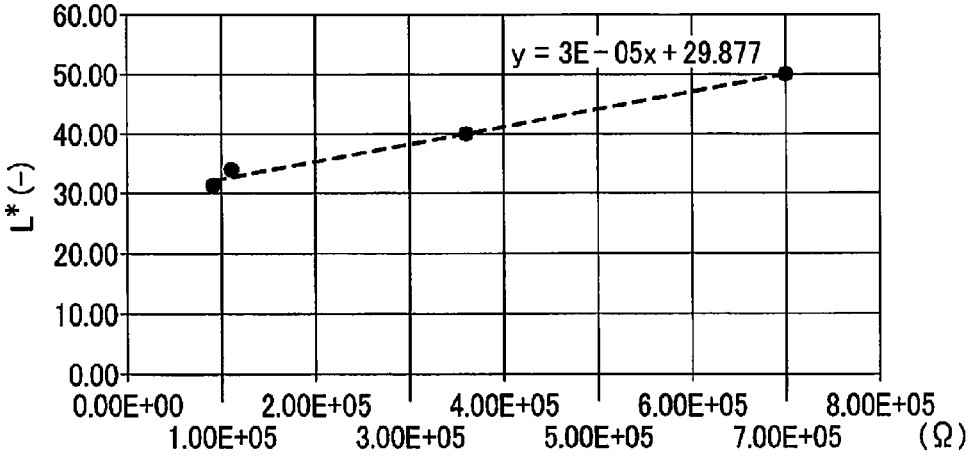
FIGS. 3A, 3B, and 3C are graphs of relations between a resistance of a charging roller according to an embodiment and color defined in L*a*b* color space by International Commission on Illumination (CIE)
Figure 3B:
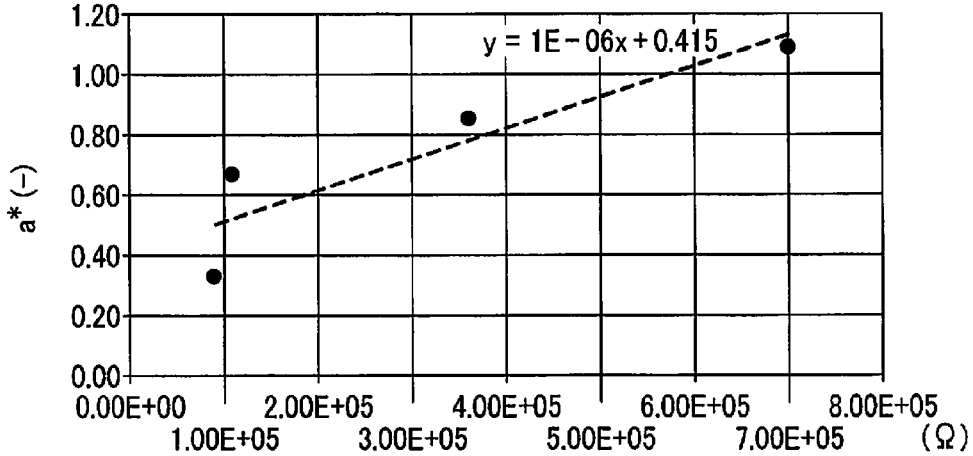
Figure 3C:
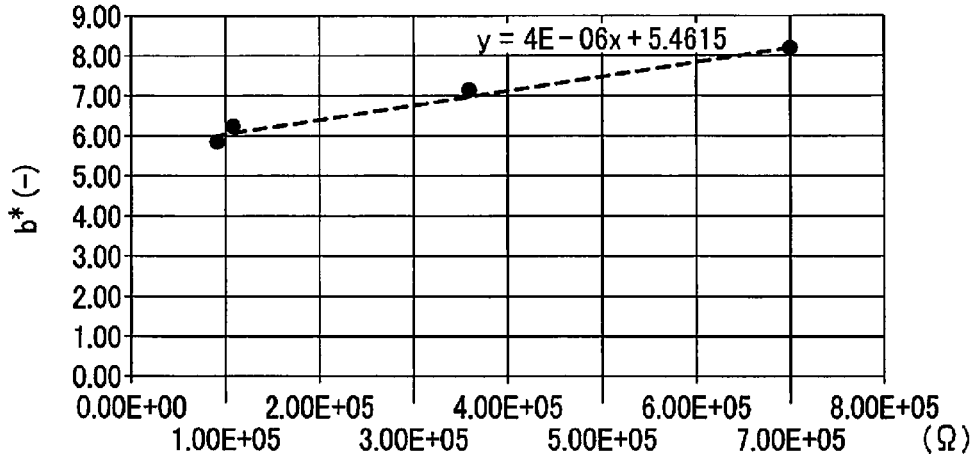
Figure 4A:
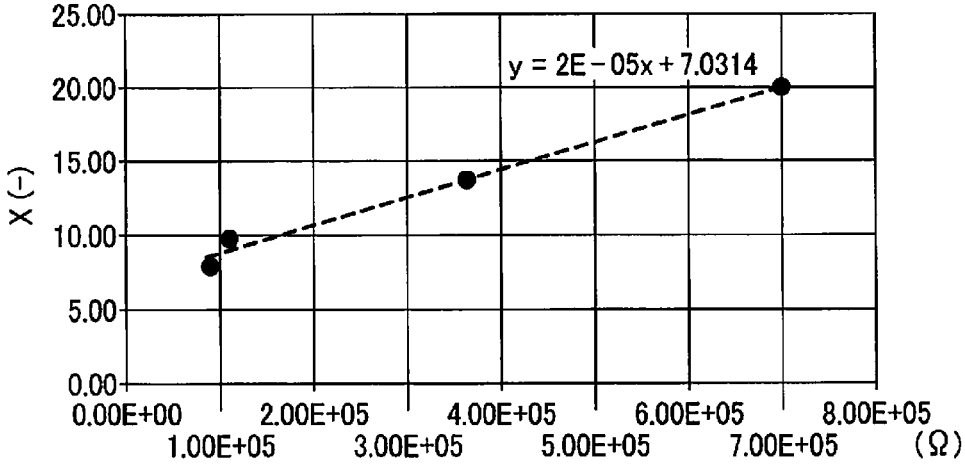
FIGS. 4A, 4B, and 4C are graphs of relations between the resistance of the charging roller and color defined in XYZ color space defined by CIF.
Figure 4B:
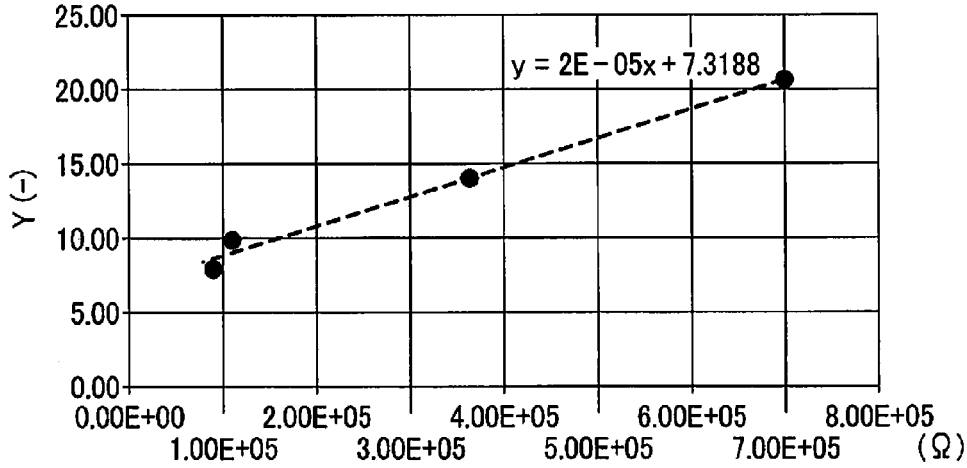
Figure 4C:
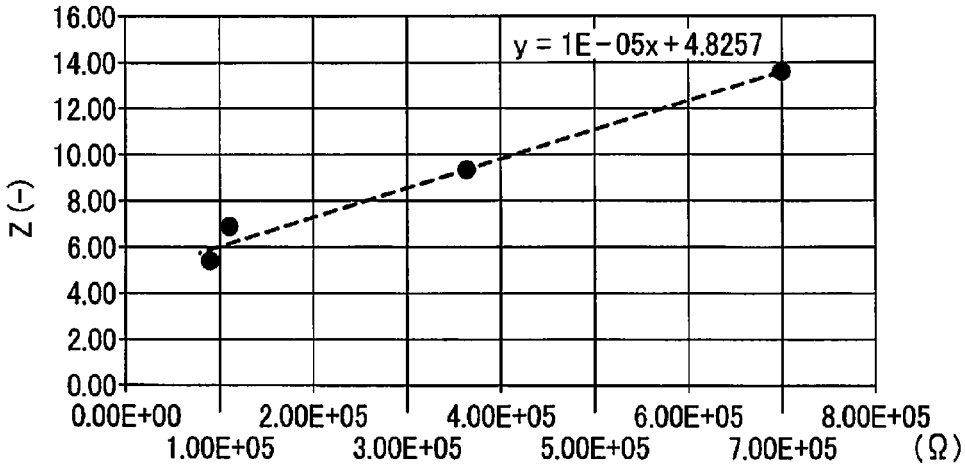

FIGS. 3A, 3B, and 3C are graphs of relations between the resistance of the charging roller 122-1 and the color thereof in L*a*b* color space defined by International Commission on Illumination (CIE), which is defined by luminance (L) channel and two color channels (a and b). FIGS. 4A, 4B, and 4C are graphs of relations between the resistance of the charging roller 122-1 and the color thereof in XYZ color space.

The resistance of the charging roller 122-1 has a substantially linear relation with each color parameter (L*, a*, b*, X, Y, and Z color directions) of the charging roller 122-1. In the relation in FIGS. 3A through 4C, the resistance were measured as follows. A load of 500 grams was applied to an end (single side) of the charging roller 1224 to contact a metal plate, and the resistance was measured under application of a voltage of 200 V. The color was measured using a contactless colorimeter, according to standard illuminant D50 and CIE 1931 standard colorimetric observer with two-degree field of view.

It is to be noted that it is possible that the resistance of the charging roller 122-1 changes depending on environments such as temperature and humidity, and it is assumed that the relation between color and resistance is controlled under standard conditions. In this case, a temperature of 23° C. and a humidity of 50% are used as the standard condition. In one embodiment, the elastic conductive layer is multilayered and includes at least a base layer and a surface layer. In another embodiment, a filler such as particles are added to the surface layer to make the surface of the charging roller 122-1 uneven.

Making the surface of the charging roller 122-1 uneven is advantageous in reducing the area of contact with the photoconductor 10, thereby inhibiting toner and the like on the photoconductor 10 from adhering to the charging roller 122-1. Additionally, since contact areas and gaps are distributed by the uneven surface of the charging roller 122-1, charging can be reliable.

The surface roughness Rz of the charging roller 122-1 is in the range of about 6 μm to about 25 μm in one embodiment and in the range of about 10 μm to about 20 μm in another embodiment. When the surface roughness Rz is too large, it is possible that image density becomes uneven in conformity with the surface roughness. When the surface roughness Rz is too small, tendency of adhesion of substances thereto increases.

To the charging roller 122-1, voltage in which an AC (alternating current) component is superimposed on a DC (direct current) component is applied. At that time, if the charging current is extremely large, damage to the photoconductor 10 is large. Then, the photoconductor 10 is more likely to wear, and the operational life thereof is reduced. Accordingly, the AC component is preferably small. However, charging becomes defective when the AC component is extremely small, and image failure occurs.

Figures 5, 6:
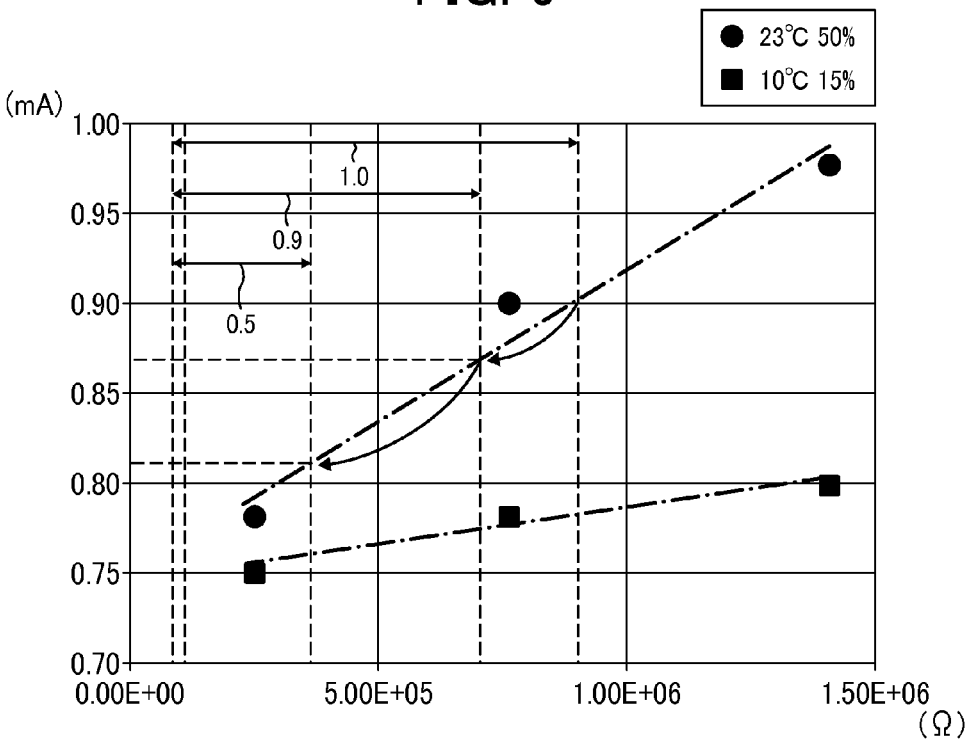
FIG. 5 is a graph of the relation between the resistance of the charging roller and a current value that results in image failure.
FIG. 6 is a table of the relation between a resistance of a charging roller according to an embodiment and a color thereof according to CIE color spaces.

Here, the term "smallest charging current" means a lower limit of a charging current range within which image failure does not occur. The inventors have experimentally confirmed that, as the resistance of the charging roller 122-1 decreases, the smallest charging current tends to decrease as illustrated in FIG. 5 and, by reducing the resistance of the charging roller 122-1, the difference due to differences in temperature and humidity is reduced, making the setting of charging current easier. In FIG. 5, the ordinate represents the smallest charging current, and the abscissa represents the resistance of the charging roller 122-1.

As described above, setting of the charging current is affected by the resistance of the charging roller 122-1. Accordingly, a fluctuation range of the resistance of the charging roller 122-1 is controlled.

For example, as illustrated in FIG. 5, assuming that the fluctuation range of the resistance of the charging roller 122-1 is within a digit of log Ω under a temperature of 10° C. and a humidity of 15%, the charging current is set at 0.9 mA or higher so that image failure does not occur considering the fluctuation range of the resistance.

The setting of charging current can be lowered to 0.87 mA by restricting the fluctuation range of resistance within 0.9 digit, that is, 0.9E+5Ω to 7.0E+5Ω as illustrated in FIG. 5. Then, the wear of the surface of the photoconductor 10 caused by excessive current is inhibited.

Further, the setting of charging current can be lowered to 0.81 mA by inhibiting the fluctuation range of the resistance within 0.5 digit, that is, 1.1E+5Ω to 3.6E+5Ω.

Lowering the charging current from 0.9 mA to 0.81 mA facilitates inhibition of damage to the photoconductor 10. In particular, the amount of abrasion over time of the photoconductor 10 is reduced by about 20%, and the operational life of the photoconductor 10 is extended.

Fluctuations in resistance of the charging roller 122-1 can be restricted within a predetermined range by preliminarily obtaining the relation between color and resistance as illustrated in FIGS. 3A through 4C based on color measurement, and establishing a formula using the relation between color and resistance.

The formula based on the relation between color and resistance illustrated in FIGS. 3A through 4C is established using the following three parameters in the present embodiment. It is to be noted that, in one embodiment, the value of resistance is obtained by a formula using one of the parameters, and the charging current is estimated.

Formula 1 below is used to calculate resistance R of the charging roller 122-1 in the case of L*a*b* color space in complementary color space defined by CIE.

$$R=\{(L^*-29.877)/3E-5+(a^*-0.415)/1E-6+(b^*-5.6415)/4E-6\}/3 \quad \text{Formula 1}$$

Formula 2 below is used in the case of XYZ color space defined by CIE.

$$R=\{(X-7.0314)/2E-5+(Y-7.3188)/2E-5+(Z-4.8257)/1E-5\}/3 \quad \text{Formula 2}$$

[Color Setting Ranges 1]

As an example, a color setting range 1 of the charging roller 122-1 in the present embodiment is as follows.

The color setting range 1 is defined according to CIE L*a*b* color space as follows.

32.6≤L*≤50.9

0.51≤a*≤1.12

6.0≤b*≤8.4

Alternatively, the color setting range 1 is defined according to CIE XYZ color spaces as follows.

8.8≤X≤21.0

9.1≤Y≤21.3

5.7≤Z≤11.8

The resistance R of the charging roller 122-1, obtained by the above-mentioned formulas with reference to the color setting range 1 above, is set as 0.9E+5(Ω)≤R≤7.0+5(Ω).

[Color Setting Ranges 1']

As another example, a color setting range 1' of the charging roller 122-1 in the present embodiment are as follows.

The color setting range 1' is defined according to CIE L*a*b* color space as follows.

33.2≤L*≤40.7

0.53≤a*≤0.78

6.1≤b*≤7.1

Alternatively, the color setting range 1' is defined according to CIE XYZ color spaces as follows.

9.2≤X≤14.2

9.5≤Y≤14.5

5.9≤Z≤8.4

The resistance of the charging roller 122-1, obtained according to the above-described formulas with reference to the color setting range 1', is within the range of 1.1E+5(Ω) ≤R≤3.6E+5(Ω).

Based on the settings described above, the inventors executed an endurance test involving feeding of 10,000 sheets under a laboratory environment, measured the amount of abrasion of the photoconductor, and identified the number of sheets corresponding to the end of the operational life of the photoconductor. The results of the endurance test are shown in the table below.

| Current value setting (mA) | Number of sheets corresponding to life end of photoconductor | Resistance of charging roller |
|---|---|---|
| 0.84 | 112K sheets | 2.4E+5 Ω |
| 0.82 | 132K sheets | 7.6E+5 Ω |
| 0.77 | 139K sheets | 1.4E+5 Ω |

From the result of calculation above, it is known that the number of sheets fed to the end of the operational life of the photoconductor varies depending on the control of the resistance value based on the measurement (or observation) of color of the charging roller 122-1.

It is to be noted that two-component developer including toner and carrier is used in the image forming apparatus 100 illustrated in FIG. 1. The toner in developer has a low melting point (Tg) and capable of melting and permeating at a relatively low temperature as described below.

To meet an increasing demand for energy saving, toner having a lower melting point is used to reduce power consumption by shortening the waiting time until image formation becomes feasible.

Regarding energy saving, the International Energy Agency (IEA) Demand-side-Management (DSM) program in 1999 involved a technique procurement project for next-generation copiers, and required specifications therefor was released.

According to the required specifications, in the case of copiers having a capability of 30 copies per minute (CPM) or greater, the waiting time should be 10 seconds or shorter, and power consumption during the waiting time should be 10 watts to 30 watts (differs depending on copying speed), which are drastic energy saving from conventional copiers.

As one approach to meet such requirements, the thermal capacity of the fixing member such as the heating roller may be reduced, thereby improving thermal response of toner. This approach, however, does not attain satisfactory effects.

To meet the above requirements and reduce the waiting time, it is conceivable that a technical requisite is lowering the fusing temperature of toner itself and lowering toner fusing temperature when the toner is usable.

Toner having a lower melting point includes a charge controlling agent as required.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluoric active agents, metal salts of salicylic acid, salicylic acid derivatives, etc.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of charge controlling agent is determined depending on the species of the binder resin used, whether or not an additive is added and toner manufacturing method (such as dispersion method) used. Although not particularly limited, the content of charge controlling agent is typically from 0.1 to 10 parts by weight. The content is preferably from 0.2 to 5 parts by weight.

When the content of the charge controlling agent is greater than 10 parts by weight, the toner has too large charge quantity, and thereby the electrostatic force of a developing roller attracting the toner increases, resulting in deterioration of the flowability of the toner and decrease of the image density of toner images.

As an external additive to improve the flowability of colorant particles, developing property, and charging capability, inorganic particles are preferably added to toner particles.

The inorganic fine particles preferably have a primary particle diameter of from $5\times10^{-3}$ μm to 2 μm, and more preferably, from $5\times10^{-3}$ to 0.5 μm.

In addition, the inorganic fine particle preferably has a specific surface area measured by a BET method of from 20 $m^2/g$ to 500 $m^2/g$.

The content of external additive is preferably from 0.01 to 5% by weight, and more preferably from 0.01 to 2.0% by weight, based on total weight of the toner composition.

Specific examples of inorganic particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Examples of particles further include polymeric particles, such as polystyrene produced by soap-free emulsion polymerization, suspension polymerization, or dispersion polymerization, methacrylate, acrylate copolymers, polycondensation products such as silicone, benzoguanamine, and nylon, polymer particles by curable resin.

The surface of such a plasticizer can be treated to enhance hydrophobicity to inhibit degradation of flowability and charging capability under hot and humid conditions.

Usable as preferable surface treatment agents include, for example, a silane coupling agent, a silylating agent, a silane coupling agent including a alkyl fluoride group, an organic titanate coupling agent, an aluminum coupling agent, silicone oil, modified silicone oil.

In particular, hydrophobized silica and hydrophobized titanium oxide produced by treating the surface of silica and titanium oxide are preferably used.

The image forming apparatus 100 illustrated in FIG. 1 operates as follows. It is to be noted that the suffixes Y, M, C, and K indicating colors are omitted in the description below.

When the image forming apparatus 100 receives print commands via a control panel or from external devices such as computers, initially the photoconductor 10 starts rotating in the direction indicated by an arrow shown in FIG. 2. Then, the charging roller 122-1 of the charging device 122 charges the surface of the photoconductor 10 uniformly to the predetermined polarity.

The exposure device 140 directs light, such as laser beams, for respective colors to the charged photoconductors 10. The laser beams are optically modulated according to multicolor image data input to the image forming apparatus 100. Thus, electrostatic latent images for respective colors are formed on the photoconductors 10.

The developing roller 123-1 of the developing device 123 supplies toner of the corresponding color to the electrostatic latent image, thereby developing the electrostatic latent image into a toner image.

Subsequently, the transfer voltage opposite in polarity to the toner image is given to the primary transfer roller 161, thereby forming a primary transfer electrical field between the photoconductor 10 and the primary transfer roller 161 via the intermediate transfer belt 162. Thus, a primary transfer nip is formed between the primary transfer roller 161 and the intermediate transfer belt 162, which press against each other with a weak pressure, and the toner image is transferred onto the intermediate transfer belt 162.

The transfer electrical field generated by the secondary transfer roller 165 transfers the multilayer toner image from the intermediate transfer belt 162 at a time onto the sheet transported from the sheet tray 131 via the sheet feeding roller 132 and the registration roller pair 133.

Then, the toner image is fixed on the sheet by the fixing device 90, after which the sheet is discharged to the output tray 100A by the ejection rollers 91.

Further, the cleaning device 124 removes toner remaining on the photoconductor 10, and the belt cleaning device 167 removes toner remaining on the intermediate transfer belt 162 after the toner image is transferred therefrom.

Meanwhile, the charging current of the charging roller 122-1 is controlled (not to become excessive) as follows to suppress wear of the surface of the photoconductor 10 and the occurrence of image failure. Measure or observe the color of the charging roller 122-1, calculate the resistance value of the charging roller 122-1 using the formula based on the relation between color and resistance of the charging roller 122-1, and keep the resistance of the charging roller 122-1 within a predetermined range.

Specifically, in a lot of charging rollers, select charging rollers having a resistance within the predetermined range obtained according to Formulas 1 and 2 and having a relatively narrow fluctuation range; and incorporate the selected charging rollers in image forming apparatuses.

Then, in each of the assembled image forming apparatuses, the charging current to the charging roller can be set to a relatively low setting. Consequently, wear of the surface of the photoconductor 10 is suppressed, and the operational life of the photoconductor 10 is extended.

For example, the relation between color and resistance such as that illustrated in FIG. 6 is incorporated in a control system that calculates the above-mentioned formulas. With this configuration, selection of the charging roller 122-1 in a target lot can be displayed and determined.

According to the embodiment described above, fluctuations in resistance of the charger is restricted in a relatively narrow range using the relation between the color and the resistance of the charger. With simple work of measuring or observing the color of the charger, a charger having a resistance within a predetermined range can be provided.

It is to be noted that, any one of the above-described features of the present specification may be embodied in the form of an apparatus, method, system, computer program and computer program product. For example, the aforementioned method of calculating the resistance of the charger may be embodied in the form of a system or device, including, but not limited to, any of the structure for performing the methodology illustrated in the drawings.

Further, any of the aforementioned method may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. A charging roller to apply voltage to a target to charge the target, wherein a color of a surface of the charging roller is in one of a range according to CIE L*a*b* color space and a range according to CIE XYZ color space, the range according to CIE L*a*b* color space is defined as:

$32.6 \leq L^* \leq 50.9$, $0.51 \leq a^* \leq 1.12$, and $6.0 \leq b^* \leq 8.4$, and the range according to CIE XYZ color space is defined as:

$8.8 \leq X \leq 21.0$, $9.1 \leq Y \leq 21.3$, and $5.7 \leq Z \leq 11.8$, wherein CIE is the International Commission on Illumination, L is luminance, a and b are color channels and XYZ are color directions and wherein a resistance of the charging roller is calculated using a measured color of the surface of the charging roller measured contactlessly and according to a preliminarily established relation between the resistance of the charging roller and the color of the surface of the charging roller.

2. The charging roller according to claim 1, wherein the charging roller has a resistance in a range from 0.9E+5Ω to 7.0+5 Ω.

3. The charging roller according to claim 1, wherein the range according to CIE L*a*b* color space is defined as:

$33.2 \leq L^* \leq 40.7$, $0.53 \leq a^* \leq 0.78$, and $6.1 \leq b^* \leq 7.1$, and the range according to CIE XYZ color space is defined as:

$9.2 \leq X \leq 14.2$, $9.5 \leq Y \leq 14.5$, and $5.9 \leq Z \leq 8.4$.

4. The charging roller according to claim 2, wherein the charging roller has a resistance in a range from 1.1E+5Ω to 3.6E+5 Ω.

5. The charging roller according to claim 1, wherein the charging roller comprises:

a metal core; and an elastic layer overlying the metal core, the elastic layer including an ion-conductive material.

6. A charging device to apply voltage to the target to charge the target, the charging device comprising the charging roller of claim 1.

7. A method of calculating a resistance of a charging roller, the method comprising:

measuring a color of a surface of the charging roller contactlessly;

establishing a relation between a resistance of the charging roller and the color of the surface of the charging roller measured; and calculating the resistance of the charging roller according to the established relation between the resistance of the charging roller and the color of the surface of the charging roller.

8. The method of claim 7, wherein the color of the surface of the charging roller is in one of a range according to CIE L*a*b* color space and a range according to CIE XYZ color space, the range according to CIE L*a*b* color space is defined as:

$32.6 \leq L^* \leq 50.9$, $0.51 \leq a^* \leq 1.12$, and $6.0 \leq b^* \leq 8.4$, and the range according to CIE XYZ color space is defined as:

$8.8 \leq X \leq 21.0$, $9.1 \leq Y \leq 21.3$, and $5.7 \leq Z \leq 11.8$, wherein CIE is the International Commission on Illumination, L is luminance, a and b are color channels and XYZ are color directions.

9. The method of claim 8, wherein the range according to CIE L*a*b* color space is defined as:

$33.2 \leq L^* \leq 40.7$, $0.53 \leq a^* \leq 0.78$, and $6.1 \leq b^* \leq 7.1$, and the range according to CIE XYZ color space is defined as:

$9.2 \leq X \leq 14.2$, $9.5 \leq Y \leq 14.5$, and $5.9 \leq Z \leq 8.4$.

10. The method of claim 7, wherein the charging roller has a resistance in a range from 0.9E+5Ω to 7.0+5 Ω.

11. The method of claim 10, wherein the charging roller has a resistance in a range from 1.1E+5Ω to 3.6E+5 Ω.

12. A charging roller to apply voltage to a target to charge the target, wherein a color of a surface of the charging roller is measured contactlessly and wherein a resistance of the charging roller is calculated according to a preliminarily established relation between the resistance of the charging roller and the measured color of the surface of the charging roller.

13. The charging roller of claim 12, wherein the color of the surface of the charging roller is in one of a range according to CIE L*a*b* color space and a range according to CIE XYZ color space, the range according to CIE L*a*b* color space is defined as:

$32.6 \leq L^* \leq 50.9$, $0.51 \leq a^* \leq 1.12$, and $6.0 \leq b^* \leq 8.4$, and the range according to CIE XYZ color space is defined as:

$8.8 \leq X \leq 21.0$, $9.1 \leq Y \leq 21.3$, and $5.7 \leq Z \leq 11.8$, wherein CIE is the International Commission on Illumination, L is luminance, a and b are color channels and XYZ are color directions.

14. The charging roller of claim 13, wherein the range according to CIE L*a*b* color space is defined as:

$33.2 \leq L^* \leq 40.7$, $0.53 \leq a^* \leq 0.78$, and $6.1 \leq b^* \leq 7.1$, and the range according to CIE XYZ color space is defined as:

$9.2 \leq X \leq 14.2$, $9.5 \leq Y \leq 14.5$, and $5.9 \leq Z \leq 8.4$.

15. The charging roller of claim 12, wherein the charging roller has a resistance in a range from 0.9E+5Ω to 7.0+5 Ω.

16. The charging roller of claim 15, wherein the charging roller has a resistance in a range from 1.1E+5Ω to 3.6E+5 Ω.

17. The charging roller according to claim 12, wherein the charging roller comprises:

a metal core; and an elastic layer overlying the metal core, the elastic layer including an ion-conductive material.

18. A charging device to apply voltage to the target to charge the target, the charging device comprising the charging roller of claim 12.

19. An image forming apparatus comprising:

the charging roller device claim 12;

an image bearer to be charged by the charging roller;

an exposure device to form an electrostatic latent image on the image bearer according to image data;

a developing device to develop the electrostatic latent image into a toner image;

a transfer device to transfer the toner image onto a transfer medium; and a cleaning device to remove toner from the image bearer after the toner image is transferred therefrom.

20. The image forming apparatus of claim 19, further comprising a common unit casing removably installable in the image forming apparatus, the common unit casing to contain the image bearer and at least one of the charging roller, the developing device, and the cleaning device.

* * * * *